United States Patent [19]

Rende

[11] 4,347,103

[45] Aug. 31, 1982

[54] METHOD FOR SULFITE PULPING USING WATER-SOLUBLE MOLYBDENUM-CONTAINING COMPOUNDS AS CATALYSTS

[75] Inventor: Dominic S. Rende, Woodridge, Ill.

[73] Assignee: Nalco Chemical Company, Oak Brook, Ill.

[21] Appl. No.: 168,923

[22] Filed: Jul. 14, 1980

[51] Int. Cl.[3] ..... D21C 3/00; D21C 3/06

[52] U.S. Cl. ..... 162/79; 162/83

[58] Field of Search ..... 162/79, 83, 65; 422/19; 423/53

[56] References Cited

U.S. PATENT DOCUMENTS 4,176,059 11/1979 Suzuki ..... 422/19
4,218,284 8/1980 Hultman ..... 162/79

FOREIGN PATENT DOCUMENTS 1478302 4/1967 France ..... 162/79
344054 12/1970 U.S.S.R. ..... 162/65
699064 11/1979 U.S.S.R. ..... 162/79

OTHER PUBLICATIONS

Kloow, "Corrosion Inhibitors for Stainless Steel", *Pulp and Paper of Canada,* vol. 80, No. 8, Aug. 1979.

*Primary Examiner*—Steve Alvo
*Attorney, Agent, or Firm*—John G. Premo; Robert A. Miller

[57] ABSTRACT

The addition of catalytic amounts of molybdenum introduced as a water-soluble molybdenum compound to the sulfite-pulping liquors, substantially increases the rate of lignin removal during chip digestion. By the use of this catalyst, the time required to delignify softwood chips in sulfite liquor at a maximum pulping temperature of 135° C. is reduced to approximately 75% of that necessary to remove the same amount of lignin without a catalyst.

3 Claims, 3 Drawing Figures

MOLYBDENUM AS A CATALYST FOR SULFITE DELIGNIFICATION

Figure 1:
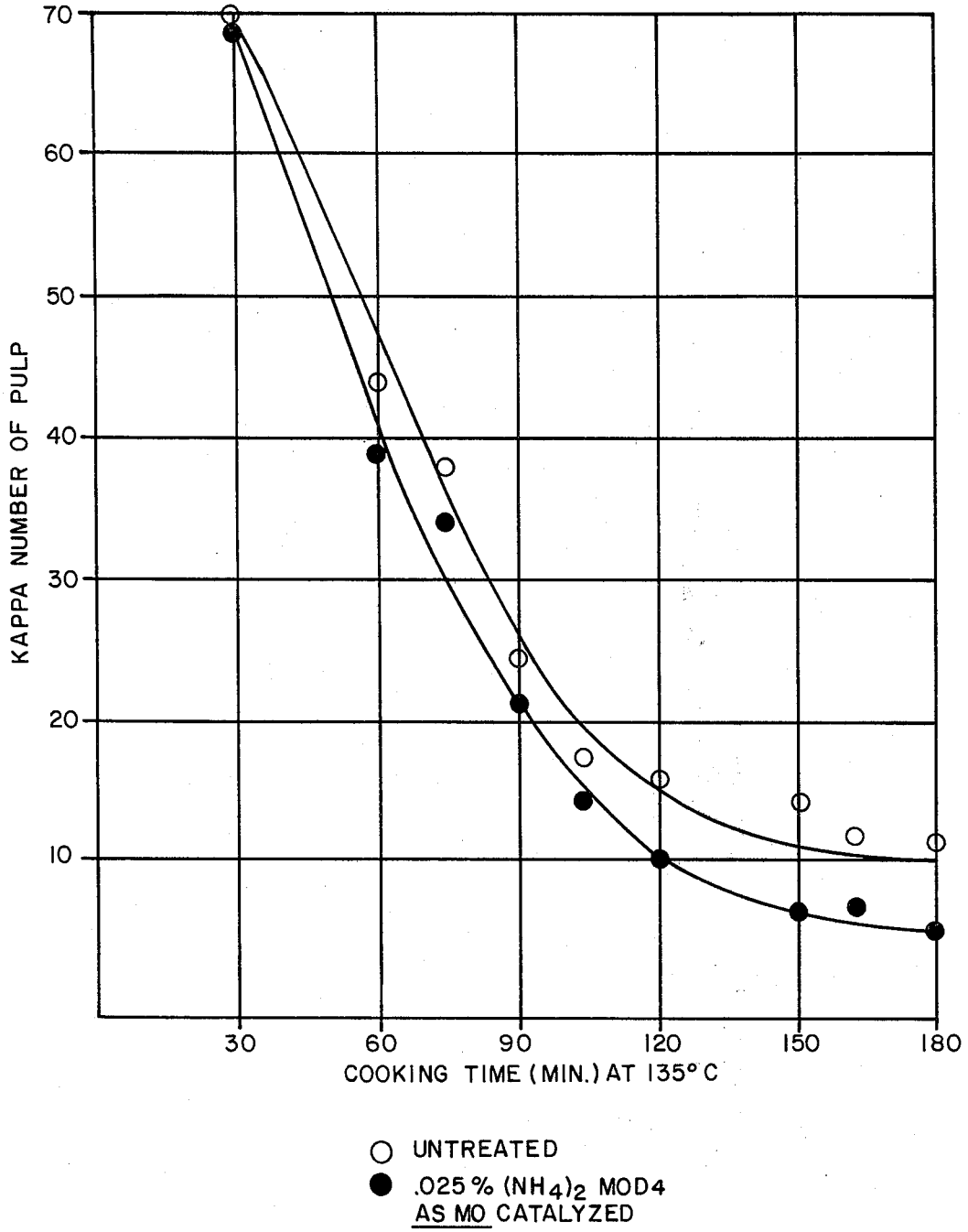

MOLYBDENUM AS A CATALYST
FOR SULFITE DELIGNIFICATION

| LBS. MO I TON | | TIME IN MINS. AT 135°C FOR KAPPA OF 12 | 15 | 18 |
|---|---|---|---|---|
| 0.00 | ● | 202 | 174 | 153 |
| 0.05 | ◐ | 168 | 153 | 142 |
| 0.10 | ○ | 161 | 147 | 135 |
| 0.15 | ◑ | 144 | 135 | 123 |
| 0.20 | ◕ | 132 | 120 | 110 |

SULFITE PULPING CATALYSIS WITH MOLYBDENUM (MO)

SULFITE PULPING CATALYSIS
WITH MOLYBDENUM (MO)

METHOD FOR SULFITE PULPING USING WATER-SOLUBLE MOLYBDENUM-CONTAINING COMPOUNDS AS CATALYSTS

INTRODUCTION

The sulfite pulping of wood is a well known process and is described extensively in *Pulp and Paper Science and Technology,* Volume 1, Pulp, edited by C. Earl Libby, McGraw-Hill Book Company, 1962, Chapter 10, the disclosure of which is incorporated herein by reference. Recently certain transition metals and various organic compounds have been reported as aqueous alkaline pulping catalysts. While these materials have shown some effectiveness, they do not sufficiently improve the process to the point that they are used to any extent commercially.

If it were possible to provide a catalyst for the sulfite pulping process of wood chips whereby the time necessary to convert the chips into pulp is substantially reduced, a valuable contribution would be made to the paper making industry.

THE INVENTION

The addition of catalytic amounts of molybdenum, introduced as water-soluble molybdenum compounds to the sulfite-pulping liquors, substantially increases the rate of lignin removal during chip digestion. By the use of a preferred catalyst, ammonium molybdate (0.025% as Mo based on oven-dried chip mass), the time required to delignify softwood chips in sulfite liquor at a maximum pulping temperature of 135° C. is reduced to approximately 75% of that necessary to remove the same amount of lignin without a catalyst.

The Water-Soluble Molybdenum Compounds

In order to obtain the catalytic effects of the invention, it is necessary that the molybdenum be utilized in a water-soluble form. Water-soluble compounds of molybdenum include the molybdates, the heterpolymolybdates, and certain other water-soluble molybdenum containing compounds. For more information with respect to these compounds, reference should be made to Volume 13 of Kirk-Othmer *Encyclopedia of Chemical Technology,* Second Edition, John Wiley & Sons, Inc., 1967, pp. 635–658, the disclosure of which is incorporated herein by reference. Of all the water-soluble molybdenum compounds that may be used, it is preferred to use either sodium or ammonium molybdate.

Included within the term, water-soluble molybdenum compounds, are those compounds of molybdenum that are capable of being solubilized in polar organic liquids, which solutions are in turn soluble or miscible with water. An example of such compounds is molybdenum pentachloride which may be pre-solubilized in a water-miscible alcohol such as ethanol, which two ingredients may be placed into water.

The amount of molybdenum compound capable of decreasing the pulping time in the sulfite process may vary. Generally, as little as 0.0025% by weight of molybdenum based on wood has proven to be effective with a dosage range between 0.005–0.100% representing a generalized range of molybdenum that can be employed to hasten the sulfite reaction that dissolves the lignins in wood fibers.

A preferred dosage range of molybdenum is between 0.005–0.025%. It is understood that larger amounts of molybdenum offer increased catalysis.

Illustrations of the Invention

To determine the effect transition metals have on the sulfite-pulping process, a series of sodium-based cooks were run in which the soluble salts of these compounds were present. Catalytic amounts (0.025% as the element) were added to the pulping liquors prior to chip digestion. The effect each additive had on the rate of delignification was measured by the permanganate number and total yield. These results are shown in Table I.

TABLE I

Catalysis of Sodium-Base Sulfite Pulping Use of Transition Metals

| Test[2] No. | Catalyst | Source | Permanganate Number[1] | Total % Yield |
|---|---|---|---|---|
| 1 | Untreated | — | 12.2 | 49.6 |
| 2 | Copper | $CuCl_2$ | 15.5 | 50.8 |
| 3 | Cobalt | $CoCl_2.6H_2O$ | 12.2 | 49.8 |
| 4 | Chromium | $K_2Cr_2O_7$ | 12.0 | 49.6 |
| 5 | Nickel | $NiCl_2.6H_2O$ | 12.0 | 49.8 |
| 6 | Lead | $PbCl_2$ | 12.0 | 49.6 |
| 7 | Untreated | — | 11.0 | 49.4 |
| 8 | Vanadium | $V_2O_5$ | 10.0 | 49.0 |
| 9 | Zinc | $ZnCl_2$ | 11.0 | 49.2 |
| 10 | Aluminum | $AlCl_3$ | 10.9 | 49.4 |
| 11 | Tin | $SnCl_2$ | 10.8 | 49.2 |
| 12 | Molybdenum | $(NH_4)_2MoO_4.4H_2O$ | 6.7 | 47.1 |

[1]Permanganate No.: The number of milliliters of 0.1 normal potassium permanganate which is absorbed by 1 gram of oven dry pulp under certain specified and carefully controlled conditions. Taken from standard TAPPI Method No. T-214.
[2]Test Nos. 1–6 represent one set while Nos. 7–12 represent a second set of treatments.

Ammonium molybdate catalyzes sulfite delignification, lowering the permanganate number by 40% as compared to the untreated control cook. A series of three additional cooks followed, each designed to determine the rate and extent of catalysis. This data is found in Table II and graphically presented in FIG. 1.

TABLE II

Molybdenum-Catalyzed Sodium-Based Sulfite Pulping

| Test No. | Treatment[1] | Mins. At 135° C. | T-236 Kappa No.[2] | % Total Yield |
|---|---|---|---|---|
| 13 | None | 75 | 38.2 | 53.0 |
| 14 | $(NH_4)_2MoO_4$ | 75 | 33.3 | 52.8 |
| 15 | None | 105 | 17.5 | 49.7 |
| 16 | $(NH_4)_2MoO_4$ | 105 | 14.0 | 48.4 |
| 17 | None | 160 | 11.5 | 48.9 |
| 18 | $(NH_4)_2MoO_4$ | 160 | 6.8 | 45.8 |
| 19 | None | 120 | 16.0 | 49.8 |
| 20 | $(NH_4)_2MoO_4$ | 120 | 10.6 | 47.9 |
| 21 | None | 150 | 15.0 | 48.9 |
| 22 | $(NH_4)_2MoO_4$ | 150 | 6.0 | 46.7 |
| 23 | None | 180 | 11.0 | 48.2 |
| 24 | $(NH_4)_2MoO_4$ | 180 | 5.3 | 43.7 |
| 25 | None | 30 | 69.5 | 56.4 |
| 26 | $(NH_4)_2MoO_4$ | 30 | 68.5 | 58.0 |
| 27 | None | 60 | 43.9 | 52.5 |
| 28 | $(NH_4)_2MoO_4$ | 60 | 39.2 | 52.6 |
| 29 | None | 90 | 25.4 | 49.8 |
| 30 | $(NH_4)_2MoO_4$ | 90 | 20.6 | 49.6 |

[1]0.025% (0.5 lbs./ton) $(NH_4)_2MoO_4$ as Mo, added to the liquor prior to chip impregnation.
[2]The Kappa number is a measurement of potentially oxidizable fraction of fiber generally regarded as lignin in nature.

To further illustrate the advantage of molybdenum as a sulfite pulping compound, a series of cooks were designed to investigate the economics of molybdenum catalysis. Promoting the reactions between sulfur dioxide and wood lignins can be justified by decreasing the total time to cook each batch, thus providing more time to increase mill production or to decrease total energy expenditures.

Figure 2:
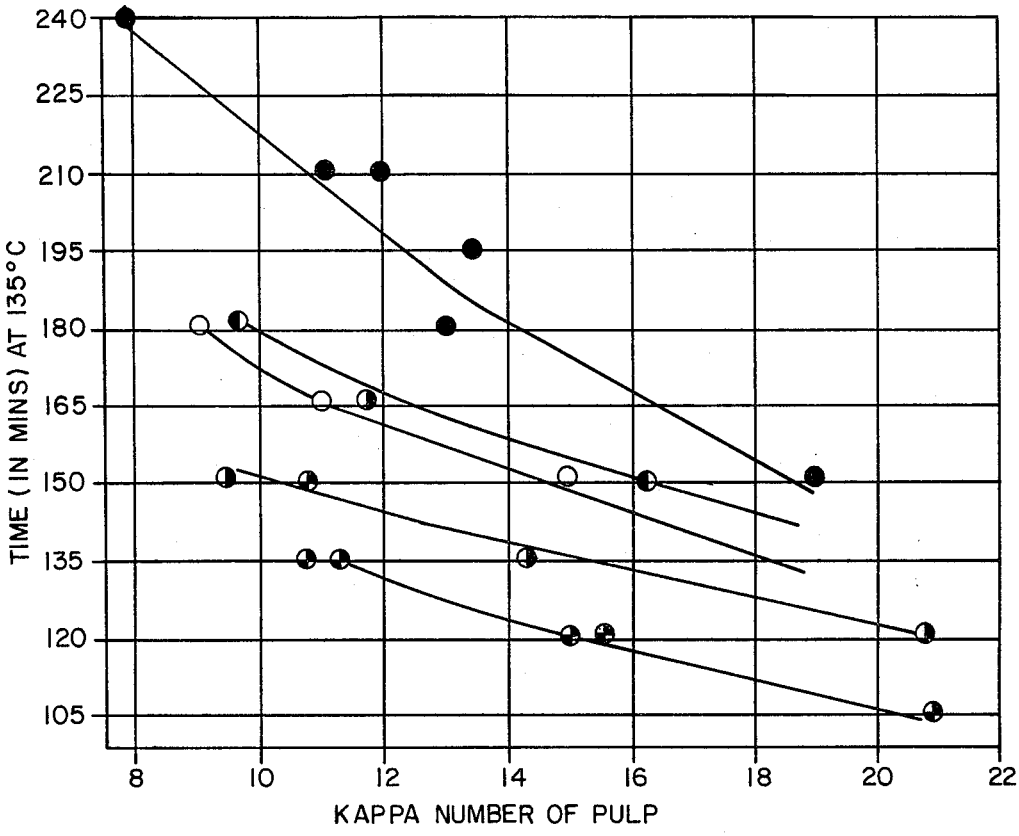
Figure 3:
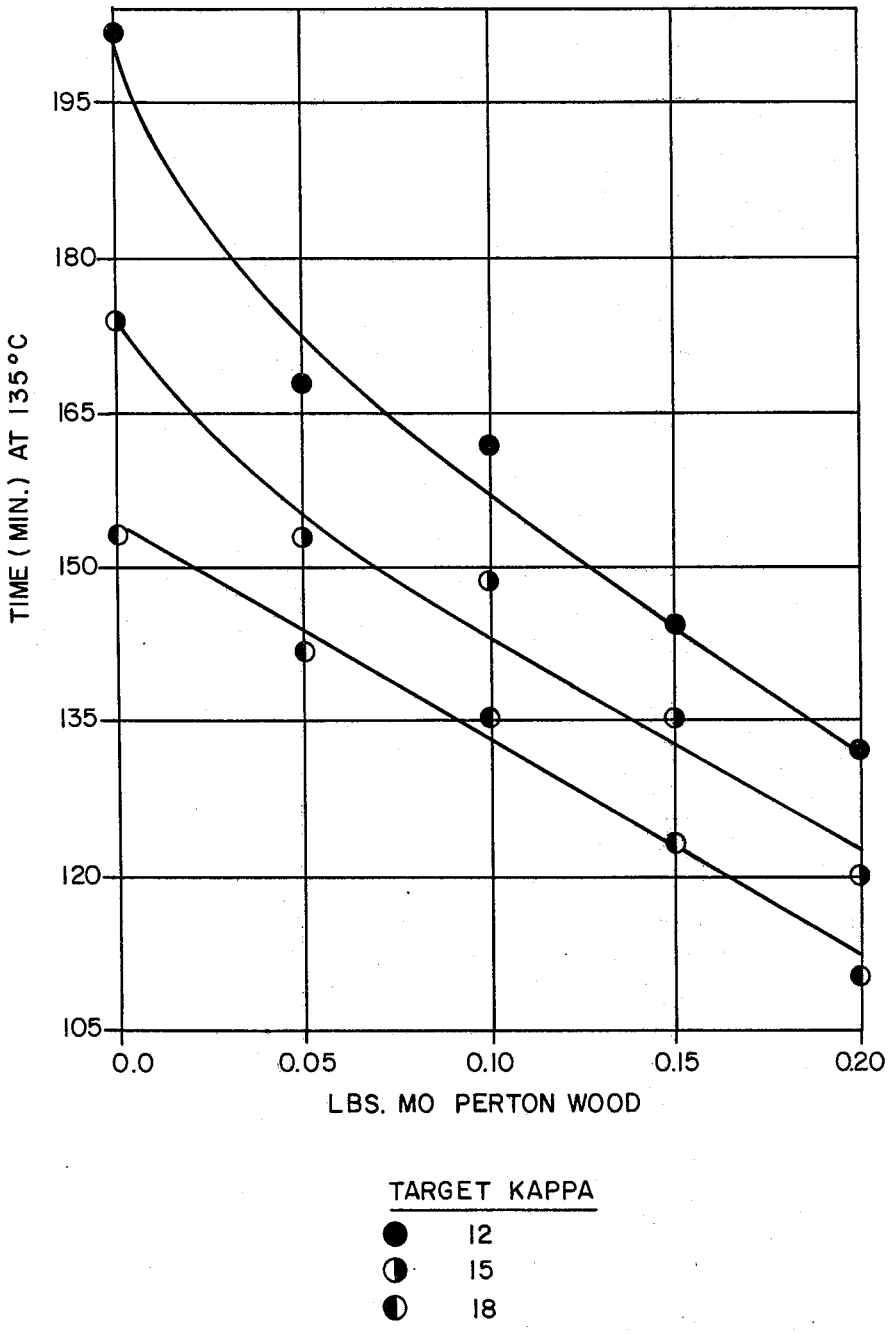

At five levels of molybdenum treatment, 0-0.01% molybdenum as Mo on weight of wood chips (applied as ammonium molybdate), the times in minutes at maximum pulping temperature vs. Kappa number over the range of 10–25 units was investigated. The graph of this study is shown in FIG. 2. From this graph, the time required to produce fiber of equivalent Kappa number for catalyzed versus uncatalyzed treatments is described. FIG. 3 extrapolates this data in the graphical form. In addition to the data described above, unbleached fiber viscosities and GE brightness were monitored.

To further illustrate the advantages of molybdenum compounds in sulfite pulping catalysis, Table III is presented.

TABLE III

| Treatment[1] | TAPPI T-236 Kappa No. of Pulp |
|---|---|
| Untreated | 15.9 |
| $Na_2MoO_4.2H_2O$ | 11.8 |
| $(NH_4)_6Mo_7O_{24}.4H_2O$ | 12.5 |
| $MoCl_5$[2] | 14.0 |

[1]0.003% as Mo based on oven dried chip weight
[2]Solubilized in ethanol prior to 1000 ppm makeup in DI water.

Conclusions

1. At a 15 Kappa number, the addition of 0.05 pounds of Mo can reduce the time at maximum temperature from 175 minutes (untreated) to 153 minutes (treated) or 12% reduction.

2. At Kappa levels above 15 units, the reduction in cooking time at maximum temperature is somewhat less than in Conclusion 1. At below Kappa 15, the percent reduction is substantially better. It would appear molybdenum is catalyzing the later portion of the sulfite cook much more rapidly than initial reactions.

3. Initial plots of Kappa number versus 0.5 M. CED capillary viscosities of uncatalyzed and treated cooks do not show appreciable differences, see Table IV.

4. The brightness of unbleached fiber within the Kappa range of 10–40 units are similar, 58% Molybdenum-catalyzed cooks show a 2–3% drop in unbleached brightness across this range. However, upon bleaching (via a C/D-E-D bleaching sequence) brightness development is not impared, see Table IV.

TABLE IV

| Test No. | Catalyst in Pulping Liquor | Unbleached Fiber Data: Kappa No. | % Yield[2] | T-230 Capillary Viscosity cPs | Post C/D-E-D Bleaching Data[3]: T-230 Capillary Viscosity cPs | % GE Brightness |
|---|---|---|---|---|---|---|
| 31 | No | 21.6 | 49.0 | 42.3 | 43.6 | 85.3 |
| 32 | Yes[1] | 21.8 | 49.0 | 40.6 | 43.1 | 86.0 |
| 33 | No | 20.8 | 49.3 | 26.4 | 29.5 | 85.9 |
| 34 | Yes[1] | 21.1 | 49.6 | 25.4 | 25.8 | 85.9 |

[1]0.005% Mo as $Na_2MoO_4$ *added to the sulfite cooking liquor prior to chip digestion.*
[2]Based on 50 gms starting chip mass prior to digestion.
[3]A 3-stage bleaching sequence, each followed by a thorough D-I water washing.
Parameters employed are as follows:

| | Chlorination | Caustic Extraction | Chlorine Dioxide |
|---|---|---|---|
| % $Cl_2$ | 5.00 | — | — |
| % NaOH | — | 2.50 | — |
| % $ClO_2$ | 0.20 | — | 0.50 |
| Time (min) | 60 | 60 | 90 |
| Temp. (°F.) | 75 | 165 | 165 |
| Consistency % | 3.0 | 10 | 10 |

Having thus described my invention, it is claimed as follows:

1. An improved method for sulfite pulping of wood chips in which wood chips are digested in a sulfite pulping liquor to produce a wood pulp, the improvement comprising adding to the sulfite pulping liquor prior to digesting the wood chips a pulping catalyst consisting essentially of 0.0025–0.100 weight percent of a water-soluble molybdenum-containing compound based on the weight of the wood chips, and pulping the wood to a Kappa No. below 15 using said water-soluble molybdenum-containing sulfite pulping liquor.

2. The method of claim 1 where the water-soluble molybdenum compound is ammonium molybdate.

3. The method of claim 1 where the water-soluble molybdenum compound is sodium molybdate.

* * * * *